US006079376A

United States Patent [19]

Dillenberg

[11] Patent Number: 6,079,376

[45] Date of Patent: Jun. 27, 2000

[54] FUEL-INJECTED PISTON COMBUSTION ENGINE

[75] Inventor: Horst Dillenberg, Wuppertal, Germany

[73] Assignee: Bergische Metallwarenfabrik, Dillenberg & Co., Haan, Germany

[21] Appl. No.: 08/913,637

[22] PCT Filed: Jan. 13, 1996

[86] PCT No.: PCT/DE96/00078

§ 371 Date: Sep. 5, 1997

§ 102(e) Date: Sep. 5, 1997

[87] PCT Pub. No.: WO96/33342

PCT Pub. Date: Oct. 24, 1996

[30] Foreign Application Priority Data

Apr. 20, 1995 [DE] Germany ..... 195 14 571

[51] Int. Cl.[7] ..... F02B 57/00

[52] U.S. Cl. ..... 123/44 C; 123/44 D

[58] Field of Search ..... 123/44 R, 44 C, 123/44 D

[56] References Cited

U.S. PATENT DOCUMENTS

| | | |
|---|---|---|
| 2,273,025 | 2/1942 | Dillström . |
| 3,200,797 | 8/1965 | Dillenberg . |
| 4,030,458 | 6/1977 | Lamm . |
| 4,154,199 | 5/1979 | Ueno . |

FOREIGN PATENT DOCUMENTS

| | | | |
|---|---|---|---|
| 935520 | 6/1948 | France . | |
| 1262597 | 4/1961 | France . | |
| 1353731 | 1/1964 | France | 123/44 D |
| 2688031 | 9/1993 | France . | |
| 418725 | 8/1966 | Switzerland . | |
| 581780 | 11/1976 | Switzerland . | |
| 1734 | of 1914 | United Kingdom . | |
| 1146674 | 4/1918 | United Kingdom . | |
| 126109 | 4/1919 | United Kingdom . | |
| 469883 | 8/1937 | United Kingdom . | |
| 565652 | 11/1944 | United Kingdom . | |

*Primary Examiner*—Michael Koczo
*Attorney, Agent, or Firm*—Martin A. Farber

[57] ABSTRACT

A fuel-injected piston combustion engine with centrally rotating cylinder block and cylinder arranged centrally therein, the rotating cylinder block being surrounded by a stationary housing which seals it off by sealing rings, the housing being provided with two scavenging ports between angles of rotation 180° and 270° calculated in direction of rotation from injection nozzles, an outlet port discharging expanded gases, while an inlet port is connected with a scavenging blower. On both sides in the stationary housing there is mounted eccentrically to the axis of the housing a linear uncranked drive shaft having a rigidly attached connecting arm which at an opposite end, in a piston, is pivotally mounted movable back and forth in the cylinder, arranged in a centrally rotating cylinder block mounted free of forces, in the vicinity of a piston end wall in a connecting rod bearing.

5 Claims, 4 Drawing Sheets

FUEL-INJECTED PISTON COMBUSTION ENGINE

FIELD AND BACKGROUND OF THE INVENTION

The present invention relates to a piston combustion engine. Such a piston combustion engine is known, for instance, from U.S. Pat. No. 3,200,797.

Such piston combustion engines afford the possibility of achieving previously unattained efficiencies by the use of very high pressure ratios of more than 1:25 and the reduction of the pressure of the exhaust gases to 1 bar, with the simultaneous possibility of supercharging the cylinders.

Such a possibility is only afforded by the construction in accordance with the invention, which is characterized by the elimination of the oscillating masses and of any valve control and of a rotary cylinder which is mounted free of forces, whereby the very high lateral forces occurring at high pressures on the cylinder wall remain ineffective. Drive-shaft offsets, such as cranks, are unsuitable with such high pressure ratios due to the unavoidable bending and the jamming caused thereby.

From the patent literature, a large number of constructions with rotating cylinders are known which contain features of the above invention, with which, however, it is not even approximately possible to attain the above purposes. British patent 469.883 discloses a construction which uses traditional connecting rods and crankshafts in a rotary cylinder. Another British patent, 126,109, discloses a construction which uses a rotating cylinder as drive member. British patent 114,667 describes a traditional radial cylinder engine in a rotating cylinder. A similar construction with traditional cranks is described in another British patent, No. 565,652. British patent 1734 from 1914 discloses a construction with crank-controlled pistons, the force being taken from the rotating cylinder. French 935.520 shows a construction by crankshaft-controlled pistons in a rotating cylinder with the use of valve timing gear. French 1.262.597 shows a construction in which the rotating cylinder is used as control member and the pistons oscillate back and forth. U.S. Pat. No. 2,273,025 shows the construction of a traditional radial cylinder engine in which the rotating cylinder is used merely as control. Finally, Swiss 418725 and U.S. Pat. No. 3,200,797 show a construction by means of crankshaft-controlled pistons, the speed of rotation of the rotating cylinder being in a ratio of 1:2 to the drive shaft. High pressure ratios cannot be used in these engines due to high lateral forces on the cylinder wall, since the rotary cylinder is not supported in a manner free of forces. The obtaining of forces from the rotary cylinder is not possible for high pressure ratios since the action of the lateral forces on the side walls is not eliminated by such constructions, and high pressure ratios can also not be used. The other constructions proposed with crankshafts are not possible for the above-mentioned reasons of bending and jamming. Traditional valve controls prevent a high efficiency.

SUMMARY OF THE INVENTION

The requirements described above, which it is necessary to satisfy in order to obtain maximum overall economic efficiency, can only be realized by a construction having a centrally rotating cylinder block and a cylinder arranged centrally therein, in the manner that a piston which is fastened to the uncranked drive shaft by a rigid connecting rod moves rotatingly displaceable, the rotation speed ratio between the cylinder block and the drive shaft being 1:1 without any intermediate gearing and the cylinder block sealed off in known manner in a stationary housing by sealing laminae and the housing being provided, also in known manner, between 180° and 270° from the injection nozzle in the direction of rotation of the cylinder block with two scavenging ports one of which is connected to a blower while the pressure-reduced exhaust gases are removed through the other one. Cylinder block and drive shaft are mounted independently of each other in the housing on both sides.

BRIEF DESCRIPTION OF THE DRAWINGS

With the above and other objects and advantages in view, the present invention will become more clearly understood in connection with the detailed description of a preferred embodiment, when considered with the accompanying drawings of which

DETAILED DESCRIPTION OF THE PREFERRED EMBODIMENT

Figure 1:
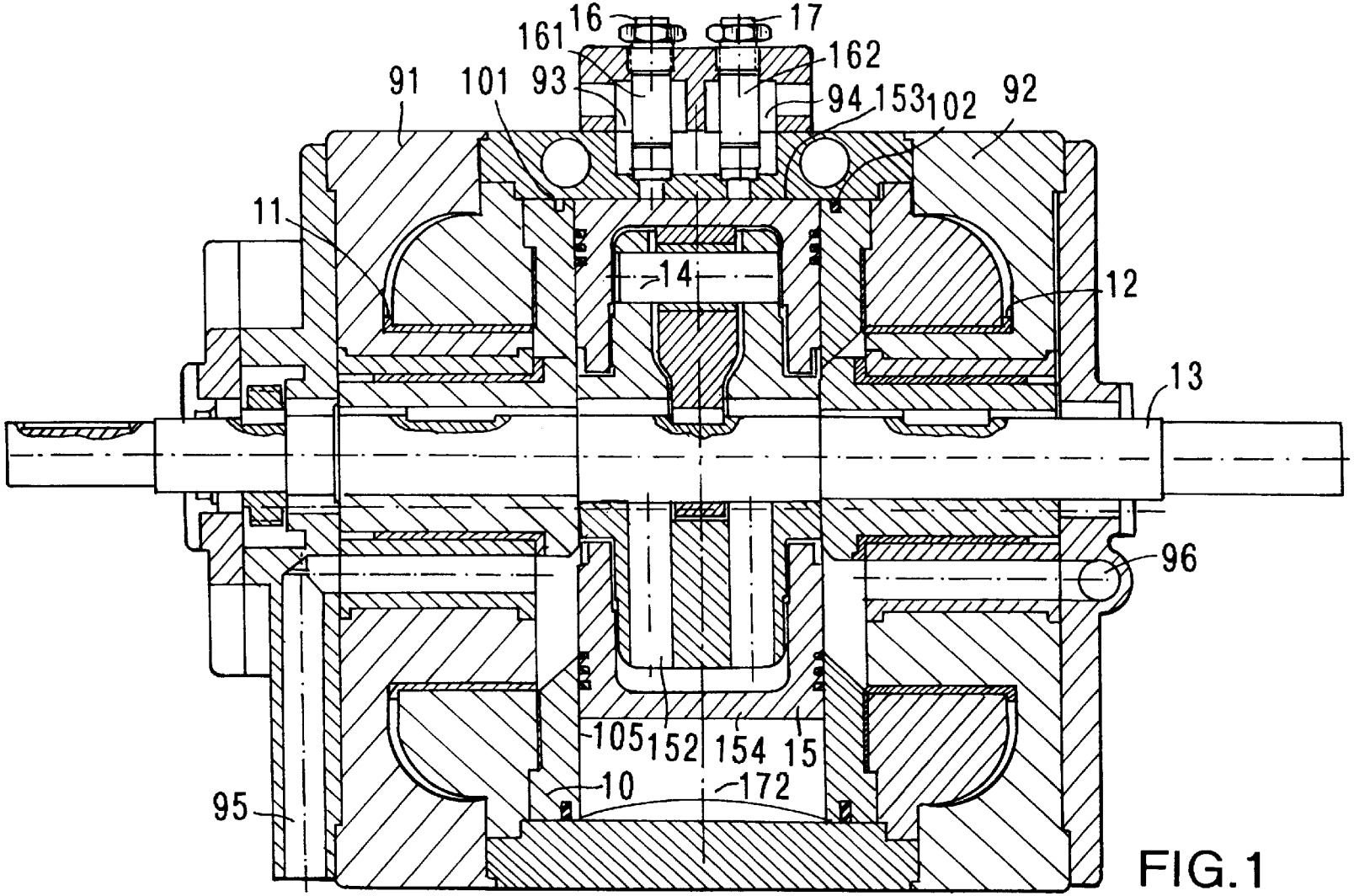
FIG. 1 is a longitudinal section through a construction in accordance with the invention.

Within the engine housing, a cylindrical housing 9, each of the ends of which is closed by a closure cap 91, 92, a cylinder block 10 which is rotatable in known manner around the center axis of the housing 9 and sealed off on its cylinder bore by sealing rings 101, 102 (FIG. 1) and straight sealing strips 103, 104 (FIG. 2) on the housing 9, is mounted in the bearings 11 and 12. Within the cylinder block 10 there is present, in known manner, a cylindrical bore 105, the cylinder of the engine, which extends diametrically perpendicular to the center line of the housing, within which bore, on an uncranked, linearly extending drive shaft 13 offset from the center of the housing, piston 15 which is rotatably mounted in the connecting rod bearing 14, is guided on the connecting arm 131 which is rigidly connected to the drive shaft 13. The piston stroke is the measure of twice the distance of the drive shaft from the axis of the housing. Cylinder block and drive shaft rotate in a ratio of 1:1, and, upon one rotation of the cylinder block 10 and the drive shaft 13, two operating strokes are carried out. At the point of the housing 9 where the piston comes closest, openings 93, 94 for the injection nozzles 16, 17 are arranged in known manner. Offset by about 230°–250° in the direction of rotation of the cylinder block 10 with respect to the injection nozzles 16, 17, the housing has, in known manner, two further openings 18, 19 (FIG. 2), opening 18 serving as outlet for the combustion gases from the working space and opening 19 serving as inlet for the fresh air fed by a blower. The cylinder block 10 and the piston 15, as can be noted from FIGS. 1 and 2, have hollow spaces 151, 152 for cooling.

Figure 2:
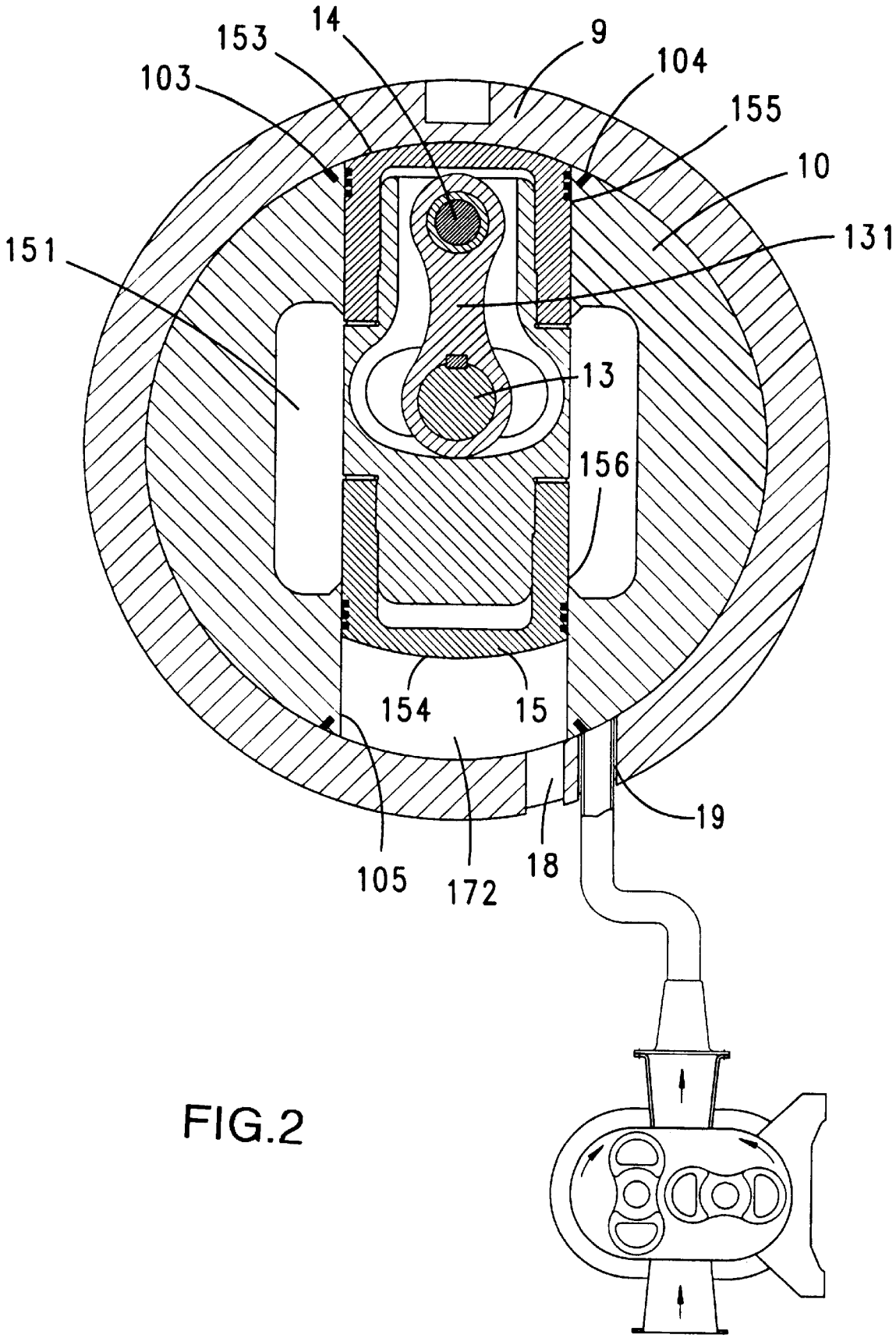
FIG. 2 is a cross section.

As can be noted from FIG. 1, the housing 9 has two bore holes 95, 96 through which cooling oil is pumped by an oil pump through cylinder block 10 and piston 15. The plain bearings are lubricated by pressurized oil. The entire cooling and lubrication can also be effected by the fuel itself if the engine is operated with heavy oil or vegetable oils.

For sealing, the cylindrical outer wall of the cylinder block 10 is provided with sealing rings 101, 102 (FIG. 1) and, in longitudinal direction, with sealing laminae 103, 104 (FIG. 2) which intersect the sealing rings 101, 102.

For the sealing of the piston in the cylinder bore, traditional piston rings 155, 156 are provided. The manner of operation of the engine in accordance with the invention is described in further detail below, with reference, in particular, to FIGS. 3–6. In this connection, it is emphasized that the engine will be operated as fuel-injected piston combustion.

Figure 3:
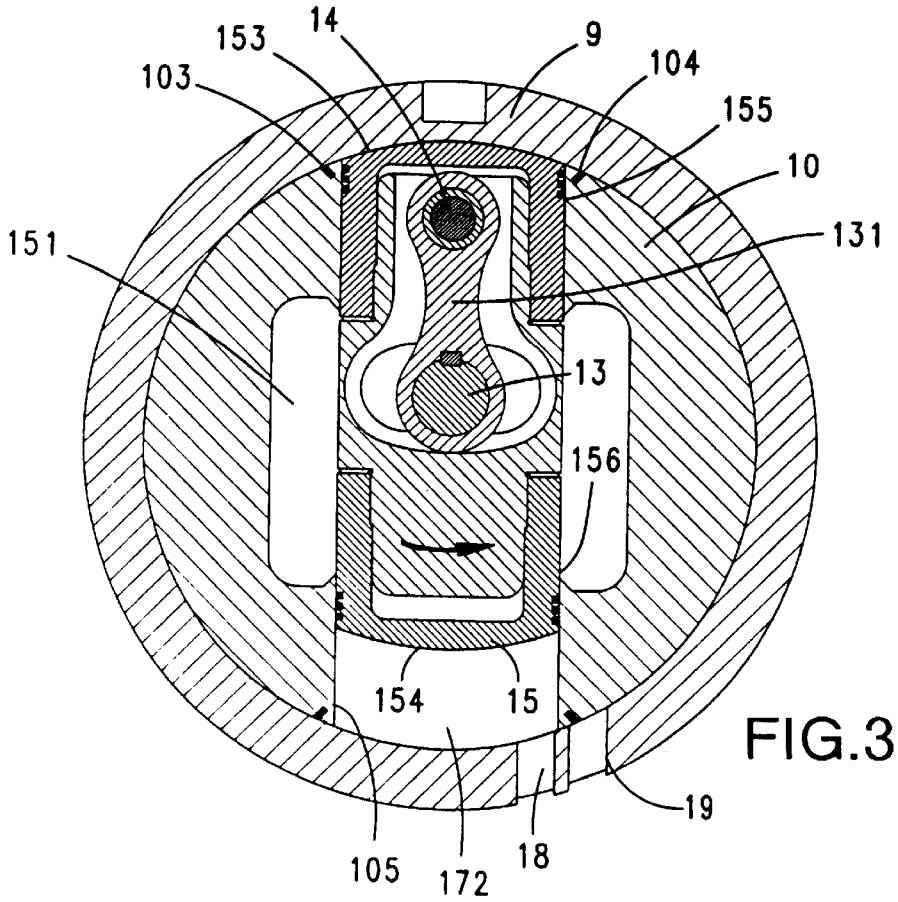
FIGS. 3–6 show different operating phases of the engine diagrammatically in cross section.
Figure 4:
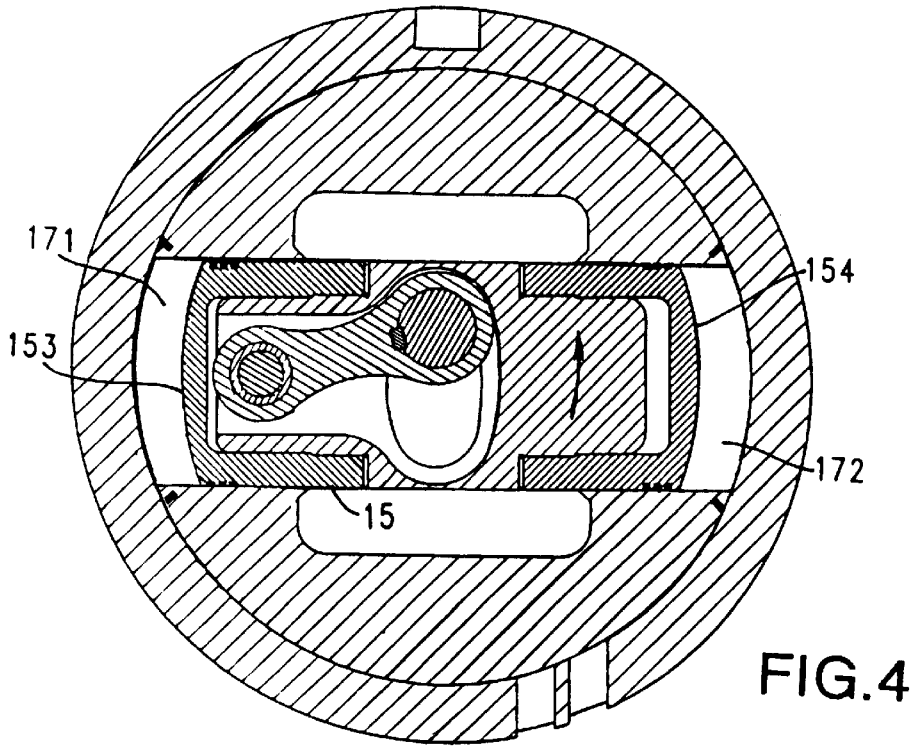
Figure 5:
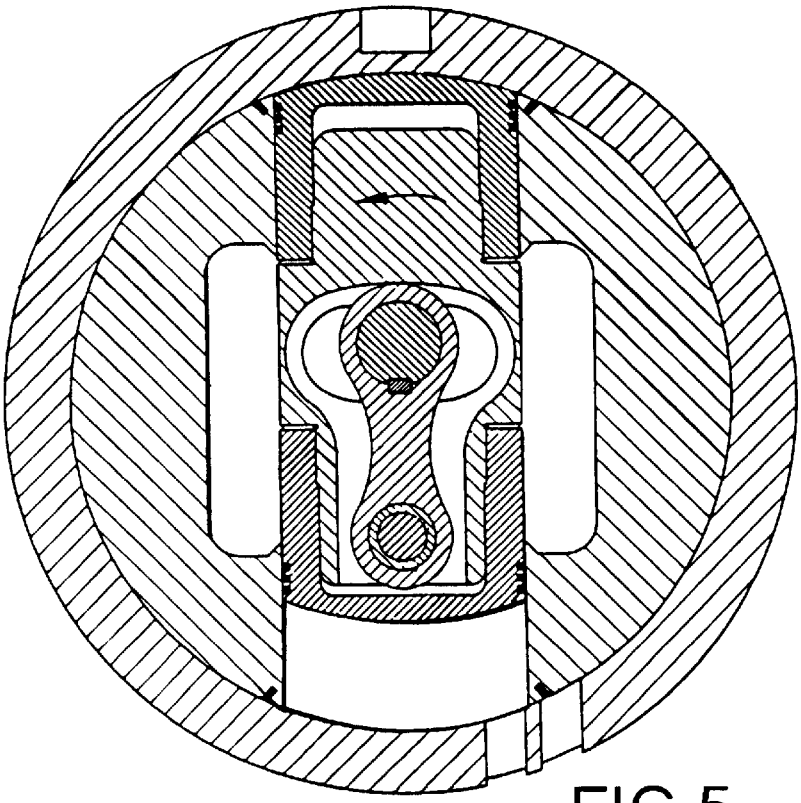
Figure 6:
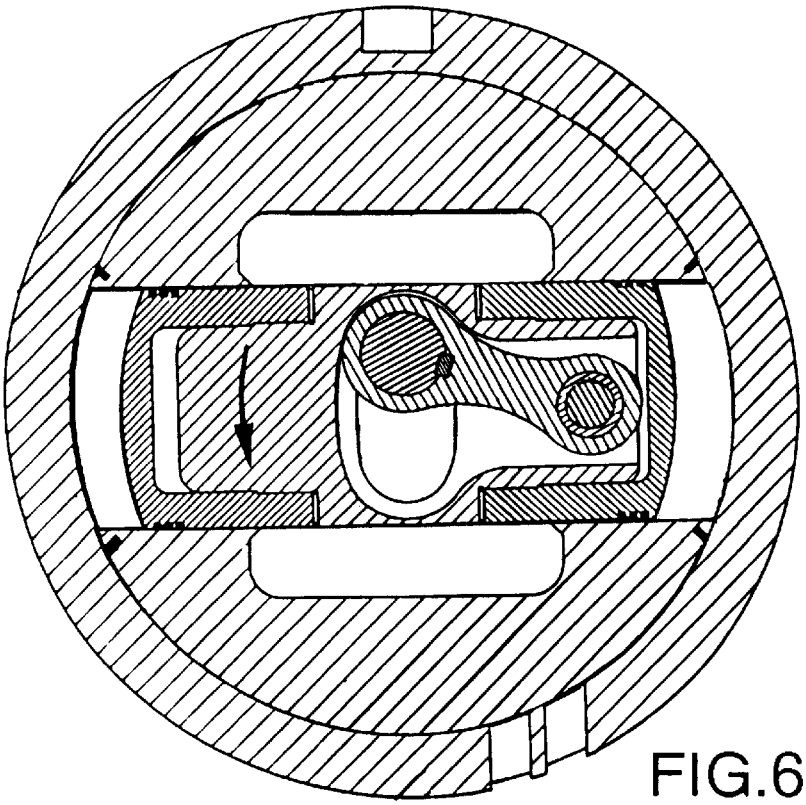

In the phase of the engine shown in FIG. 3, the piston 15 has reached top dead-center, whereby, at the same time, the greatest possible compression of the air has taken place in the compression spaces 161, 162 (FIG. 1) between the piston end wall 153 and the housing 9 (FIG. 1). After fuel has been injected into the compression space by the injection nozzles 16, 17, the expansion force produces a stroke of the piston 15 in the direction of the arrow indicated in the piston and a rotation in counterclockwise direction, since the drive shaft 13 is turned in this direction by the starter. On the opposite side of the piston, namely in the working space 172 between the piston end wall 154 of the piston 15 and the housing 9, discharge of the burned gases takes place, they escaping through the port 18. The further development of the sliding movement of the piston and the rotary movement of the cylinder block can be noted from FIG. 4, in which the piston has been turned 90° with respect to its initial position. At the same time, there takes place, on the opposite side of the piston, namely in the working space 172, between the end wall 154 of the piston 15 and the housing 9, compression of the air which was previously blown through the scavenging port 19 by a blower for the scavenging of the exhaust gases through the port 18 and, after somewhat further rotation of the drive shaft 13, after covering the exhaust port 18, served for the supercharging of the work space 172. As shown in FIG. 5, the compression in the work space 172 is now complete and the end wall 154 of the piston 15 is now in the position opposite the compression spaces 161, 162, where the air has then reached the highest possible compression.

The opposite end wall 153 of the piston 15, is now in communication with the outlet port 18, where the burned gases can now escape. Cylinder block 10 and drive shaft 13 now have the same position and have therefore each turned 180° . As can be noted from FIG. 4, the drive shaft has in this connection been initially accelerated and then experiences deceleration on the way to FIG. 5. The degree of acceleration and of deceleration depends on the structurally produced distance of the drive shaft 13 from the connecting rod arm 14. FIG. 6 then again shows, in the same way as FIG. 4, the compression of the air, this time between the end wall 153 of the piston 15 and the housing 9, which air had been blown in in the previous position shortly after FIG. 5, through the port 19 in order to flush the exhaust gases out through the port 18 and for the subsequent supercharging of the working space 171.

As can be noted from FIGS. 2, 3, 4, 5 and 6, the scavenging ports 18, 19 are shifted about 230° from the top dead center of the piston 15, whereby, in known manner, the compression path is shortened as compared with the expansion path, so that the compression volume is less than the expansion volume. In this way, a complete reduction of the pressure of the exhaust gases can be obtained. Upon a revolution of the drive shaft 13 and thus also of the cylinder block 10, two operating strokes are produced.

Only by means of this arrangement of partially known parts is it possible to satisfy the aforementioned requirements for the obtaining of maximum overall economic efficiency with the simplest construction namely:

1. Elimination of the oscillating masses,
2. Use of a high pressure ratio,
3. Obtaining of an efficiency of 100% with simultaneous continuation of the expansion to 1 bar,
4. Force-free mounting of the cylinder block by uncranked straight drive shaft,
5. Heavy-oil and vegetable-oil operation with simultaneous cooling by the fuel, possible as a result of the high compression and the very high ignition temperatures obtained thereby.

Strength calculations have shown that the connecting rod bearing in the piston and the bearing of the drive shaft can be accommodated at pressures of 400 kg/cm2 without difficulty. By the elimination of the crankshaft bearing, see Swiss 418725, the construction can be kept smaller and more compact since, as a result of the high compression forces, the arms of the crankshaft would have to be made very strong, which fact would require a considerably larger amount of space.

As a result of the absence of the crankshaft bearing in the piston, as described in Swiss 418725, the piston can be made substantially hollow, as a result of which a reliable cooling can be effected by oil or the fuel itself, even with the substantially lower specific heat of the oil or fuel as compared with water. In this way, it can be guaranteed that the slide-surface temperatures do not exceed 250° C.

The construction is thus established mechanically and thermally for these peak pressures. The obtaining of an efficiency of 100% with simultaneous expansion to 1 bar is obtained solely and exclusively in known manner by this manner of arrangement of the scavenging ports in the housing wall. Thus, a scavenging path of 60°–90° cylinder block angle is obtained, in which connection an intensive reverse scavenging takes place and a volumetric efficiency of 100% is obtained. In addition, in the event of overlapping of the scavenging ports, a supercharging to an air pressure of the desired height depending on the arrangement of the scavenging ports can be obtained.

As a result of the high compression ratio and the high compression temperatures thereby occurring, due to the existence of the minute compression spaces and the central position of the injection nozzle upon direct injection, there is a spontaneous ignition of the fuel with good mixing, whereby it is possible, for the first time, to allow the diesel principle to take place in accordance with the constant-volume process, whereby a considerable amount of work output is gained as compared with the constant-pressure process which is customary in traditional engines.

The invention thus results from the carefully precalculated thermodynamic conditions for obtaining an efficient and economic combustion machine, with simultaneous consideration of the mechanical strengths, the results of which can be obtained only by this combination of, in part, known parts with scavenging ports arranged in known manner.

What is claimed is:

1. A fuel-injected piston combustion engine with centrally rotating cylinder block and cylinder arranged centrally therein, the rotating cylinder block being surrounded by a stationary housing which seals it off by sealing rings, the housing being provided with two scavenging ports between angles of rotation 180° and 270° calculated in direction of rotation from injection nozzles, an outlet port discharging expanded gases, while an inlet port is connected with a scavenging blower, wherein on both sides in the stationary housing there is mounted eccentrically to the axis of the housing a linear uncranked drive shaft having a rigidly attached connecting arm which at an opposite end, in a piston, is pivotally mounted movable back and forth in said cylinder, arranged in a centrally rotating cylinder block mounted free of forces, in a vicinity of a piston end wall in a connecting rod bearing.

2. A fuel-injected piston combustion engine according to claim 1, wherein the connecting arm which is rigidly attached to the uncranked drive shaft mounted eccentrically to the center of the housing, mounted in the connecting rod arm, moves the piston slidingly back and forth, whereby the piston carries out two strokes upon a revolution of the drive shaft.

3. A fuel-injected piston combustion engine according to claim 1, wherein the ratio of rotation of the drive shaft with respect to the cylinder block is 1:1 and upon one revolution of the drive shaft and the cylinder block the piston carries out two working cycles and two scavenging cycles.

4. A fuel-injected piston combustion engine according to claim 1, wherein the cylinder block is unconnected by gearing to the drive shaft but is controlled solely and exclusively by distribution of forces on a bottom of the piston.

5. A fuel-injected piston combustion engine according to claim 1, wherein heavy oil or vegetable oil is used as fuel, and the fuel itself is used as coolant.

* * * * *